US012162065B2

(12) United States Patent
Zhou et al.

(10) Patent No.: US 12,162,065 B2
(45) Date of Patent: Dec. 10, 2024

(54) THIN METAL STRIP CONTINUOUS CASTING METHOD USING MOMENTUM FLOW DISTRIBUTION

(71) Applicant: University of Science and Technology Beijing, Beijing (CN)

(72) Inventors: Cheng Zhou, Beijing (CN); Dongpo Xuan, Beijing (CN); You Zhou, Beijing (CN); Tianliang Jiang, Beijing (CN); Biji Zhu, Beijing (CN); Wenhao Fan, Beijing (CN); Zhihao Zhang, Beijing (CN); Jianxin Xie, Beijing (CN)

(73) Assignee: University of Science and Technology Beijing, Beijing (CN)

( * ) Notice: Subject to any disclaimer, the term of this patent is extended or adjusted under 35 U.S.C. 154(b) by 0 days.

(21) Appl. No.: 18/556,167

(22) PCT Filed: Jul. 21, 2022

(86) PCT No.: PCT/CN2022/107129
§ 371 (c)(1),
(2) Date: Oct. 19, 2023

(87) PCT Pub. No.: WO2023/109125
PCT Pub. Date: Jun. 22, 2023

(65) Prior Publication Data

US 2024/0367221 A1 Nov. 7, 2024

(30) Foreign Application Priority Data

Dec. 17, 2021 (CN) ..... 202111554142.9

(51) Int. Cl.
*B22D 11/103* (2006.01)
*B22D 11/06* (2006.01)

(52) U.S. Cl.
CPC ..... *B22D 11/103* (2013.01); *B22D 11/0622* (2013.01)

(58) Field of Classification Search
CPC ..... B22D 11/103; B22D 11/0622; B22D 11/0637; B22D 11/064
See application file for complete search history.

(56) References Cited

U.S. PATENT DOCUMENTS 4,790,368 A * 12/1988 Kusakawa ..... B22D 11/0622 164/489

FOREIGN PATENT DOCUMENTS

CA 2347209 A1 4/2002
CN 1148526 A 4/1997
(Continued)

*Primary Examiner* — Kevin P Kerns
*Assistant Examiner* — Steven S Ha
(74) *Attorney, Agent, or Firm* — Sisson & Banyas, Attorneys at Law, LLC; Jeffrey J. Banyas

(57) ABSTRACT

A thin metal strip continuous casting method using momentum flow distribution, comprising the steps of: adjusting the position of a flow distribution device (2), and starting a double-roller thin strip continuous casting apparatus; molten metal (3) forming a uniform sheet-shaped molten metal flow (4) having an initial momentum after the molten metal (3) passes through the flow distribution device; the sheet-shaped molten metal flow entering a molten pool (5) at a superheat degree of 50-100° C. and an initial velocity of 0.5-2 m/s, wherein the flow distribution device is spaced apart from the molten pool; under the action of the initial velocity of the molten metal and in the molten pool, forming a whirlpool, which is adjacent to surfaces of two cooling rollers and has a momentum stirring action; and completing the solidification of the molten metal under the momentum stirring action of the whirlpool along with the rotation of the two cooling rollers. In the method, a whirlpool, which is adjacent to surfaces of cooling rollers and has a momentum stirring
(Continued)

action, is formed in a molten pool by means of the kinetic energy of molten metal, such that equiaxed crystals can be prepared when a superheat degree is as high as 50-100° C., and the proportion of equiaxed crystals can be increased to 100%, thereby refining crystal grains and alleviating segregation.

10 Claims, 5 Drawing Sheets

(56) References Cited

FOREIGN PATENT DOCUMENTS

| | | | |
|---|---|---|---|
| CN | 102069165 | A | 5/2011 |
| CN | 104962811 | A | 10/2015 |
| CN | 114309505 | A | 4/2022 |
| CN | 216828556 | U | 6/2022 |
| GB | 9618644 | | 6/1996 |
| JP | H05245591 | A | 9/1993 |
| JP | H06269911 | A | 9/1994 |
| JP | H0857584 | A | 3/1996 |
| JP | H0947852 | A | 2/1997 |
| JP | 2021079418 | A | 5/2021 |
| WO | 2013086535 | A1 | 6/2013 |

* cited by examiner

THIN METAL STRIP CONTINUOUS CASTING METHOD USING MOMENTUM FLOW DISTRIBUTION

The present disclosure claims priority to Chinese Patent Application No. 202111554142.9 filed to the CNIPA on Dec. 17, 2021 and International Patent Application No. PCT/CN2022/107129 filed to WIPO on Jul. 21, 2022 both of which are entitled "THIN METAL STRIP CONTINUOUS CASTING METHOD USING MOMENTUM FLOW DISTRIBUTION", the disclosure of each of which is incorporated herein by reference in its entirety.

TECHNICAL FIELD

The present application relates to a thin metal strip continuous casting method using momentum flow distribution and is applied to the technical field of thin metal strip continuous casting.

BACKGROUND

Crystal grains with a small size difference in all directions are called equiaxed crystals, and crystal grains with a large size difference in all directions are correspondingly called columnar crystals. The equiaxed crystals have uniform properties, while the columnar crystals have directional properties. Metal materials obtain dense and uniform equiaxed crystal structures, so that the mechanical and technological properties of the metal materials can be improved.

Double-roller thin strip continuous casting is a near-net-shape continuous casting technology. By using this technology, a strip blank with a thickness close to that of the finished product can be prepared, and the short-flow production of the thin metal strip can be realized. This technology greatly simplifies the production process, shortens the length of the production line and reduces the device investment, and can significantly reduce the cost, save energy and protect the environment, so that this technology has a very promising market prospect. The double-roller thin strip continuous casting uses two water cooling rollers as moving crystallizers. According to the movement direction of casting the thin strip, the arrangement mode of the casting machine can be classified into a horizontal double-roller thin strip continuous casting device with vertically arranged cooling rollers, a vertical double-roller thin strip continuous casting device with horizontally arranged cooling rollers, and an inclined double-roller thin strip continuous casting device with obliquely arranged cooling rollers. In the prior art, in the horizontal double-roller thin strip continuous casting process, the molten metal of the low pressure head enters the molten pool in form of a laminar flow through the feed nozzle; in the vertical double-roller thin strip continuous casting process, the molten metal enters the molten pool through a submerged flow distributor, and the kinetic energy of the molten metal is reduced by taking various measures so as to suppress the whirlpool in the molten pool; and, in the inclined double-roller thin strip continuous casting process, the molten metal enters the molten pool in form of a laminar flow.

Chinese Patent CN103464702A disclosed a metal sheet near-net-shape forming device and a forming method thereof, wherein the metal sheet near-net-shape forming device has a pair of casting rollers which are obliquely arranged, internally provided with water cooling and rotate reversely; a molten metal flow distribution device is arranged on one side of the lower casting roller; the molten metal is uniformly spread on the surface of the lower casting roller by the flow distribution device, and the molten metal then forms a molten pool between the upper and lower casting rollers, thereby completing the solidification and rolling of the molten metal and realizing the near-net-shape formation of the metal sheet. In this patent, the molten metal is uniformly spread on the surface of the lower casting roller, so the whirlpool having a momentum stirring action cannot be formed.

U.S. Pat. No. 7,604,039B2 disclosed a flow distribution device, wherein molten steel in the ladle enters a tundish though a water port and then enters the flow distributor through a fireproof device; a plurality of flow distribution outlets are formed on the side face of the bottom of the flow distributor; the flow distributor nozzle of the flow distribution device is submerged in the molten steel, and the flow rate of the molten steel at the outlet of the flow distributor is reduced as far as possible, thereby alleviating the fluctuation of the liquid level and meniscus of the molten pool and controlling the stability of the molten pool. Since the flow distributor has a plurality of flow distribution outlets, the flow distribution of the molten steel in the axial direction will not be uniform, so that the temperature field distribution in the molten pool is not uniform and cracks occur in the thin strip. Meanwhile, the molten steel slowly enters a larger molten pool and cannot form a whirlpool with a momentum stirring action. The temperature update rate of the molten steel is slow, the temperature gradient in the molten pool is large, and the unidirectional growth conditions are sufficient, so it is easy to a solidification structure represented by columnar crystals, and the crystal grains in the solid phase transformation structure are also relatively coarse. Thus, subsequent processes such as rolling and deformation are needed to obtain fine equiaxed crystal structures and satisfy the mechanical performance requirements of thin strip products. If the proportion of equiaxed crystals in the cast strip solidification structure can be improved, the crystal grains would be refined, the segregation would be improved, and the burden of subsequent processes would be reduced.

Chinese Patent CN100493745C disclosed a method for improving equiaxed crystallization rate by double-roller thin strip continuous casting, wherein, in the casting process, the mixed gas of argon and hydrogen is introduced into molten steel to reduce the oxygen partial pressure, thereby reducing the supercool degree of the molten steel, changing the solidification conditions of the molten steel and increasing the contact time of the molten steel and the crystallization roller in the liquid state. Thus, the heat transfer between the crystallization roller and the solidified shell is improved. This method can improve the surface quality of sheets, and can control the solidification structure of sheets, improve the proportion of equiaxed crystals of sheets and refine crystal grains by controlling the proportion of the mixed gas. This method has the following disadvantages: the device is relatively complicated and inconvenient to operate, and it is difficult to control the local contact state of the mixed gas with the molten steel and the surface of the crystallization roller in this method, so that the heat transfer between the molten steel and the crystallization roller is not stable and the thin strip structure is not uniform. This method can enlarge the equiaxed crystal region, but cannot obtain sheets with 100% equiaxed crystal structure.

Chinese Patent CN102069167A disclosed a method for preparing an oriented silicon steel isometric crystal thin strip blank by double-roller thin strip continuous casting, including controlling key process parameters such as the superheat degree of molten steel in the thin strip continuous casting process and the contact arc length and contact time of the molten steel in the molten pool and the surface of the crystallization roller, thereby obtaining equiaxed crystal grains. This method has the following disadvantages: the superheat degree of the molten steel needs to be controlled to be 15-30° C., and the temperature control range is narrow, so that the control difficulty is increased and the obtained equiaxed crystal structure is still coarse. On one hand, when casting is performed to a certain extent, with the reduction of the temperature of the molten steel in the ladle, the molten steel is easy to solidify at the tundish and the water port, or jamming accidents occur due to too long solidification section. On the other hand, sine the superheat degree is higher than the temperature range, the stirring effect in the molten pool in this patent is not obvious, and it is not conducive to the development of equiaxed crystals. The reason why the equiaxed crystal thin strip can be prepared at 15-30° C. in this patent is that the initial superheat degree is too low and the supercool degree is too high, resulting in the increase of the nucleation rate. Also, the relatively coarse equiaxed crystal structure is formed due to not high increase of the nucleation rate. It is known to those skilled in the art that the structure of the prepared thin metal strip is considered as a columnar crystal structure instead of an equiaxed crystal structure if the superheat degree is higher than 50° C.

It can be seen that there is no technical teaching in the prior art to make full use of the kinetic energy of molten metal to form a whirlpool adjacent to the surface of the cooling roller in the molten pool so as to prepare the equiaxed crystal structure. On the contrary, in the prior art, in order to avoid the fluctuation of molten metal entering the flow distributor, the nozzle of the flow distributor is generally submerged in the molten metal or the molten metal enters the nozzle of the flow distributor with weak advection. Even if the equiaxed crystal structure can be prepared, the superheat degree needs to be controlled below 30° C., and the prepared equiaxed crystal structure is relatively coarse. Therefore, in the prior art, there is a need for a thin metal strip continuous method and device that can prepare 100% equiaxed crystal structure at a higher superheat degree.

SUMMARY OF THE INVENTION

An objective of the present application is to provide a thin metal strip continuous casting method using momentum flow distribution, wherein a whirlpool, which is adjacent to surfaces of cooling rollers and has a momentum stirring action, is formed in a molten pool by means of the kinetic energy of molten metal, such that equiaxed crystals can be prepared when the superheat degree is as high as 50-100° C., and the proportion of equiaxed crystals in the solidification structure of the casting strip can be increased to 100%, thereby refining crystal grains and alleviating segregation.

The present application relates to a thin metal strip continuous casting method using momentum flow distribution, including the following steps of:

(1) adjusting the position of a flow distribution device, and starting a double-roller thin strip continuous casting device;

(2) molten metal entering the flow distribution device, and the molten metal forming a sheet-shaped molten metal flow which is uniform in an axial direction and has an initial momentum after the molten metal passes through the flow distribution device;

(3) the sheet-shaped molten metal flow entering a molten pool at a superheat degree of 50-100° C. and an initial velocity of 0.5-2 m/s, where the flow distribution device is spaced apart from the molten pool, so that the flow distribution device does not come into contact with the molten pool;

(4) under the action of the initial velocity of the molten metal, in the molten pool, forming a whirlpool which is adjacent to surfaces of two cooling rollers and has a momentum stirring action; and (5) completing the solidification of the molten metal under the momentum stirring action of the whirlpool along with the rotation of the two cooling rollers to obtain a thin metal strip, where the solidification structure of the thin metal strip is a uniform and fine equiaxed crystal structure.

The double-roller thin strip continuous casting device may be an inclined double-roller thin strip continuous casting device including an upper cooling roller and a lower cooling roller; the upper cooling roller and the lower cooling roller are obliquely arranged, and a roller gap is formed between the upper cooling roller and the lower cooling roller; the flow distribution device is arranged above the lower cooling roller. The flow distribution device may include: an inlet section opened upward, which is configured to receive the molten metal; a vertical outlet section connected to the inlet section, a continuous strip-shaped outlet being formed on the bottom of the vertical outlet section to output the sheet-shaped molten metal flow; and, a flow guide plate, which is connected to one side of the vertical outlet section and configured to guide the sheet-shaped molten metal flow to flow out. The length of the vertical outlet section may be 3-10 times of the thickness of the vertical outlet section, the length of the flow guide plate may be 5-10 times of the thickness of the vertical outlet section, and the distance from the intersection of the flow guide plate and the vertical outlet section to the bottom of the vertical outlet section may be 1.5-3 times of the thickness of the vertical outlet section. The angle $\alpha$ between the connecting line of the output endpoint of the flow distribution device with the axis of the lower cooling roller and a vertical line may be 0-70°, the angle $\beta$ between the connecting line of the axes of two cooling rollers and the vertical line may be 30-90°, and the angle $\alpha$ is less than the angle $\beta$; and, the difference between the angle $\gamma$ between the plate surface of the flow guide plate and a horizontal line and the angle $\alpha$ may be 0-5°.

The double-roller thin strip continuous casting device may also be a vertical double-roller thin strip continuous casting device including a first cooling roller and a second cooling roller which are arranged horizontally; the flow distribution device is arranged above the position where the first cooling roller and the second cooling roller are symmetrical, and a roller gap is formed therebetween. The flow distribution device may include: an inlet section opened upward, which is configured to receive the molten metal; and, a vertical outlet section connected to the inlet section, a continuous strip-shaped outlet being formed on the bottom of the vertical outlet section to output the sheet-shaped molten metal flow. The length of the vertical outlet section may be 3-10 times of the thickness of the vertical outlet section.

In the thin metal strip continuous casting method using momentum flow distribution according to the present application, a sheet-shaped molten metal flow which is uniform in the axial direction and has an initial momentum is provided by momentum flow distribution, i.e., by a flow distribution device, so that the momentum of the molten metal entering the molten pool is high and the momentum stirring effect in the molten pool is obvious. The formation of the equiaxed crystal structure can be promoted by the strong momentum stirring effect of the whirlpool in the molten pool, the equiaxed thin strip can be prepared at a superheat degree of 50-100° C., and the 100% equiaxed crystal structure can be formed.

DETAILED DESCRIPTION

Figure 1:
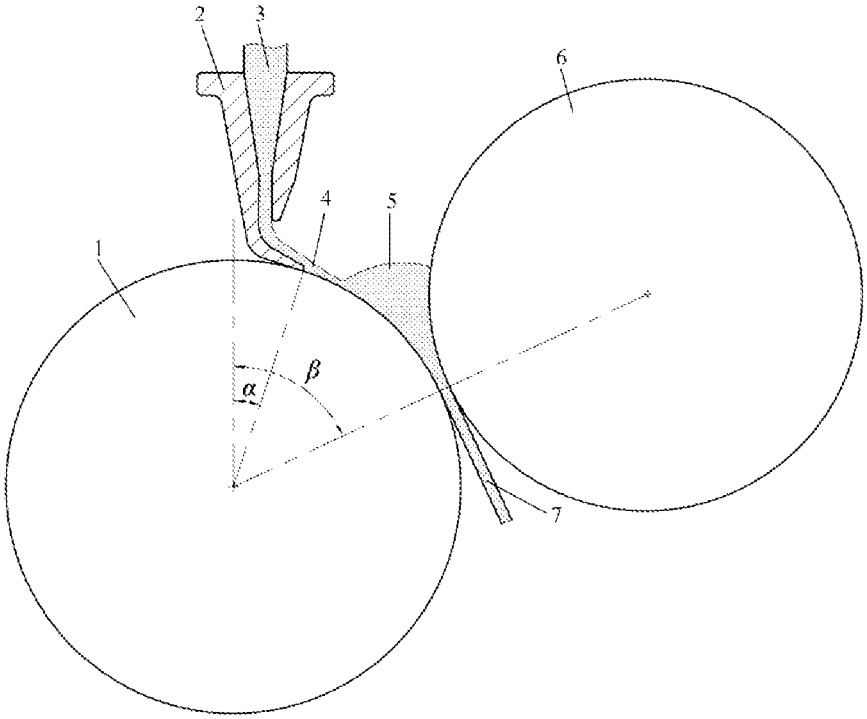
FIG. 1 is a schematic diagram of the thin metal strip continuous casting device in Embodiment 1.
Figure 2:
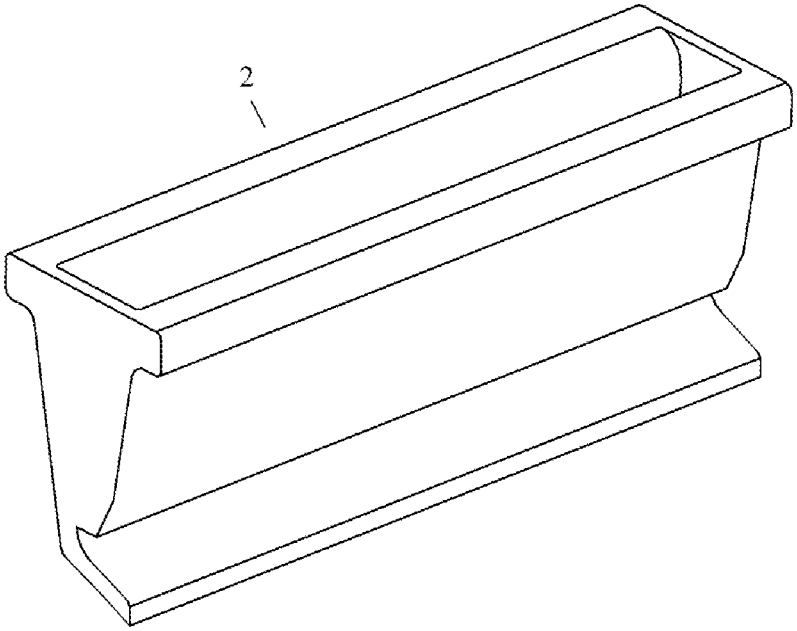
FIG. 2 is a stereoscopic diagram of the flow distribution device in Embodiment 1.
Figure 3:
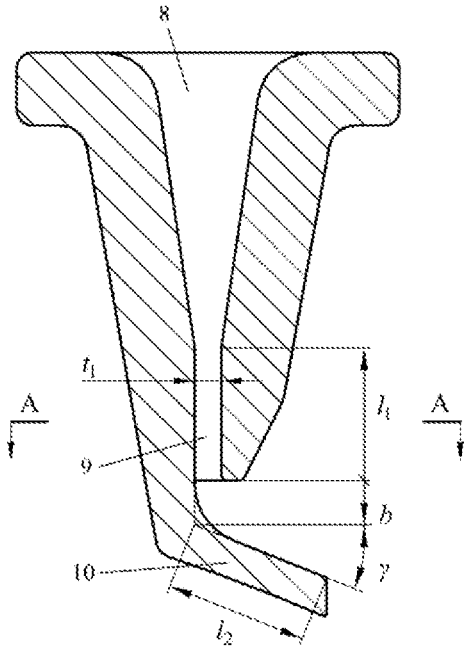
FIG. 3 is a sectional view of the flow distribution device in Embodiment 1.
Figure 4:
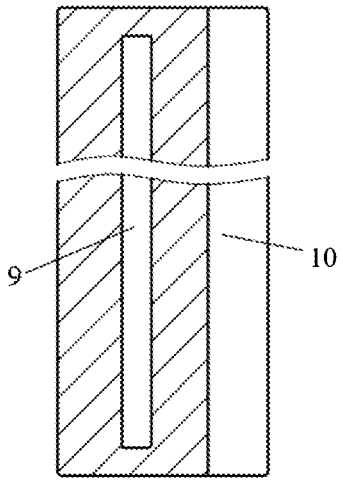
FIG. 4 is a sectional view of FIG. 3 along A-A.
Figure 5:
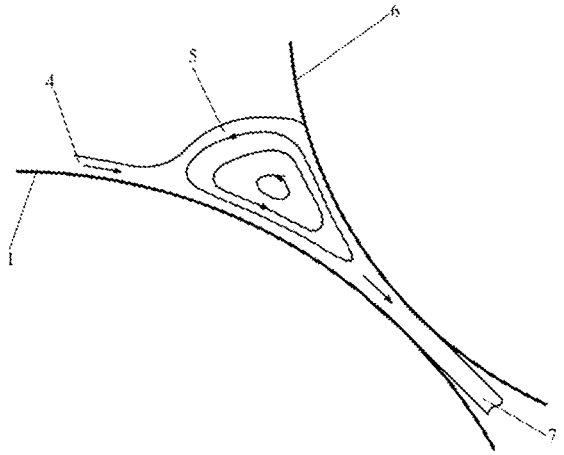
FIG. 5 is a schematic diagram of the momentum distribution and the whirlpool in the molten pool in Embodiment 1.
Figure 6:
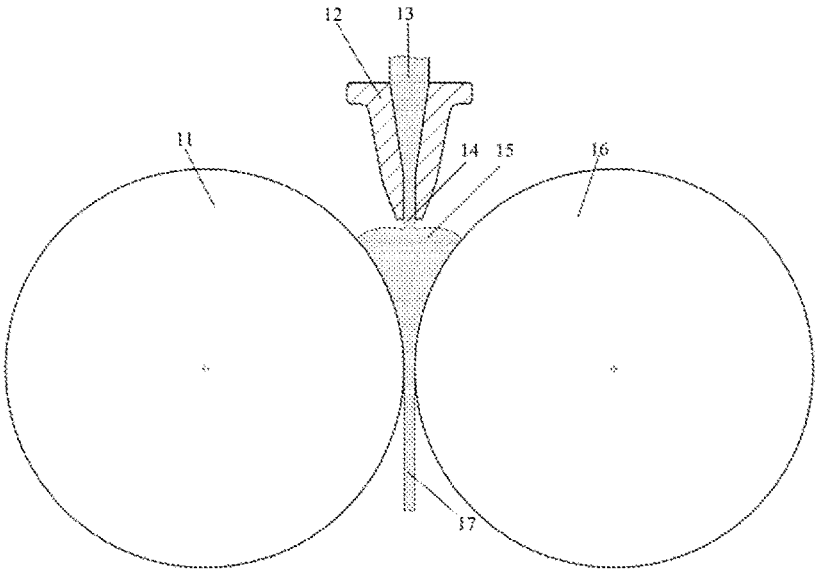
FIG. 6 is a schematic diagram of the thin metal strip continuous casting device in Embodiment 2.

To make the objectives, technical solutions and advantages of the present application clearer, the embodiments of the present application will be described below in detail with reference to the accompanying drawings. It is to be noted that the embodiments in the present application and the features in the embodiments can be arbitrarily combined with each other if not conflicted.

The present application relates to a thin metal strip continuous casting method using momentum flow distribution, including the following steps of:

(1) adjusting the position of a flow distribution device, and starting a double-roller thin strip continuous casting device;

(2) molten metal entering the flow distribution device, and the molten metal forming a sheet-shaped molten metal flow which is uniform in an axial direction and has an initial momentum after the molten metal passes through the flow distribution device, where the axial direction refers to the axial direction of double rollers;

(3) the sheet-shaped molten metal flow entering a molten pool at a superheat degree of 50-100° C. and an initial velocity of 0.5-2 m/s, where the flow distribution device is spaced apart from the molten pool, so that the flow distribution device does not come into contact with the molten pool;

(4) under the action of the initial velocity of the molten metal, in the molten pool, forming a whirlpool which is adjacent to surfaces of two cooling rollers and has a momentum stirring action; and (5) completing the solidification of the molten metal under the momentum stirring action of the whirlpool along with the rotation of the two cooling rollers to obtain a thin metal strip, where the solidification structure of the thin metal strip is a uniform and fine equiaxed crystal structure.

The momentum flow distribution in the present application requires the molten metal to have a high initial velocity, thereby ensuring that the momentum entering the molten pool is high and the momentum stirring effect in the molten pool is obvious, and, the formation of the equiaxed crystal structure is promoted by the strong momentum stirring effect of the whirlpool in the molten pool. The momentum stirring effect of the whirlpool is beneficial to strengthen the heat exchange between the molten metal and the cooling rollers, improve the temperature uniformity of all parts of the molten pool, reduce the temperature gradient and increase the supercool degree and the nucleation rate. The momentum stirring of the whirlpool can break the dendritic crystals, thereby suppressing the formation and growth of columnar crystals and refining crystal grains. Moreover, the momentum stirring of the whirlpool can also make components more uniform, thus alleviating segregation. The whirlpool is developed more fully, the effects of refining the solidification structure, increasing the proportion of equiaxed crystals and alleviating segregation is better. The momentum stirring effect can realize the formation of equiaxed crystals at a superheat degree of 50-100° C. and can effectively avoid the blockage at the tundish and the water port.

Moreover, since the sheet-shaped molten metal flow entering the molten pool is uniform and continuous, the whirlpool formed in the molten pool is kept uniform along the axis of the cooling rollers, thereby realizing uniform solidification and improving the surface quality.

Embodiment 1

As shown in FIGS. 1-5, the thin metal strip continuous casting method using momentum flow distribution in the present application may be implemented by an inclined double-roller thin strip continuous casting device. The method includes the following steps.

(1) The position of a flow distribution device is adjusted, and a double-roller thin strip continuous casting device is started.

(2) Molten metal enters the flow distribution device, and the molten metal forms a sheet-shaped molten metal flow which is uniform in an axial direction and has an initial momentum after the molten metal passes through the flow distribution device.

(3) The molten metal flow enters a molten pool formed by two cooling rollers and two side seals, at a superheat degree of 50-100° C. and an initial velocity of 0.5-2 m/s along the surface of the lower roller, where the flow distribution device is spaced apart from the molten pool and the flow distribution device does not come into contact with the molten pool.

(4) Under the action of the initial velocity of the molten metal, in the molten pool, a whirlpool which is adjacent to surfaces of two cooling rollers and has a momentum stirring action is formed.

(5) The solidification of the molten metal is completed under the momentum stirring action of the whirlpool along with the rotation of the two cooling rollers to obtain a thin metal strip, where the solidification structure of the thin metal strip is a uniform and fine equiaxed crystal structure.

As shown in FIGS. 1-4, the inclined double-roller thin strip continuous casting device includes a first cooling roller 1 located on the lower side and a second cooling roller 6 located on the upper side. The first cooling roller 1 and the second cooling roller 6 are obliquely arranged, and a roller gap is formed between the first cooling roller 1 and the second cooling roller 6. The flow distribution device 2 is arranged above the first cooling roller 1, and the molten metal 3 flows out of the flow distribution device 2 to form a sheet-shaped molten metal flow 4 which is uniform in the axial direction and has an initial momentum. The angle α between the connecting line of the output endpoint of the flow distribution device 2 with the axis of the lower cooling roller and a vertical line is 0-70°, preferably 20-60°, for example 40°; the angle β between the connecting line of the axes of two cooling rollers and the vertical line is 30-90°, preferably 60-80°, for example 70°; and, the angle α is less than the angle β. The initial momentum may be adjusted by the height between the liquid level of the tundish or flow groove and the flow distribution device. In order to ensure the full development of the whirlpool, the flow distribution device does not come into contact with the molten pool. The sheet-shaped molten metal flow enters the roller gap between the first cooling roller 1 and the second cooling roller 6 at an initial velocity of 0.5-2 m/s along the surface of the first cooling roller to form a molten pool 5, and the subsequent sheet-shaped molten metal flow forms whirlpool momentum in the molten pool 5. The first cooling roller 1 and the second cooling roller 6 rotate synchronously in opposite directions, and the roller velocity may be 0.1-3 m/s. The solidification of the molten metal is completed under the momentum stirring action of the whirlpool. The prepared thin metal strip 7 is extracted from the roller gap between the first cooling roller 1 and the second cooling roller 6, and the solidification structure of the thin metal strip 7 is a uniform and fine equiaxed crystal structure.

The flow distribution device 2 includes an inlet section 8 opened upward, which is configured to receive the molten metal from the tundish; a vertical outlet section 9 connected to the inlet section 8, a continuous strip-shaped outlet being formed on the bottom of the vertical outlet section 9 to output the sheet-shaped molten metal flow; and, a flow guide plate 10, which is connected to one side of the vertical outlet section 9 and configured to guide the sheet-shaped molten metal flow to flow out. The length $l_1$ of the vertical outlet section 9 is 3-10 times, preferably 5-7 times of the thickness $t_1$ of the vertical outlet section 9, the length $l_2$ of the flow guide plate 10 is 5-10 times, preferably 7-8 times of the thickness $t_1$ of the vertical outlet section 9, and the distance b from the intersection of the flow guide plate 10 and the vertical outlet section 9 to the bottom of the vertical outlet section 9 is 1.5-3 times, preferably 2-2.5 times of the thickness $t_1$ of the vertical outlet section 9. The angle γ between the surface of the flow guide plate 10 and the horizontal line is γ=α+5, where 5 is the angle deviation between α and γ and may be 0-5°. By the combination of the size relationship and the angle relationship, the sheet-shaped molten metal flow flowing into the roller surface along the flow guide plate can form a good momentum stirring effect in the molten pool, and the whirlpool stirring required for preparing 100% equiaxed crystals is realized.

In a comparative example, the molten metal enters the molten pool space along the surface of the lower roller at a superheat degree of 70° C. and an initial velocity of 1 m/s, and a whirlpool which is adjacent to the surfaces of two cooling rollers and has a momentum stirring action is formed in the molten pool. Under the action of the momentum stirring of the whirlpool, the solidification of the molten metal is completed, and a thin metal strip is prepared. The solidification structure is a uniform and fine 100% equiaxed crystal structure, and the size of crystal grains is 80 m.

Embodiment 2

As shown in FIGS. 6-10, the thin metal strip continuous casting method using momentum flow distribution in the present application may be implemented by a vertical double-roller thin strip continuous casting device. This method includes the following steps.

(1) The position of a flow distribution device is adjusted, and a double-roller thin strip continuous casting device is started.

(2) Molten metal enters the flow distribution device through a tundish or flow groove, and the molten metal forms a sheet-shaped molten metal flow which is uniform in an axial direction and has an initial momentum after the molten metal passes through the flow distribution device.

(3) The molten metal flow enters a molten pool formed by two cooling rollers and two side seals, at a superheat degree of 50-100° C. and an initial velocity of 0.5-2 m/s along the symmetrical plane of adjacent surfaces of the two cooling rollers, where the flow distribution device is spaced apart from the molten pool.

(4) Under the action of the initial velocity of the molten metal, in the molten pool, a whirlpool which is adjacent to surfaces of two cooling rollers and has a momentum stirring action is formed.

(5) The solidification of the molten metal is completed under the momentum stirring action of the whirlpool along with the rotation of the two cooling rollers to obtain a thin metal strip, where the solidification structure of the thin metal strip is a uniform and fine equiaxed crystal structure.

Figure 7:
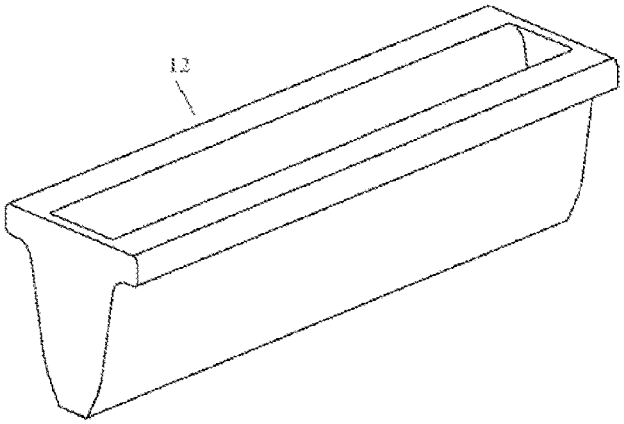
FIG. 7 is a stereoscopic diagram of the flow distribution device in Embodiment 2.
Figure 8:
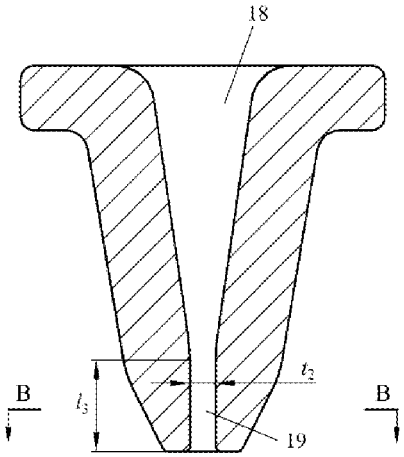
FIG. 8 is a sectional view of the flow distribution device in Embodiment 2.
Figure 9:
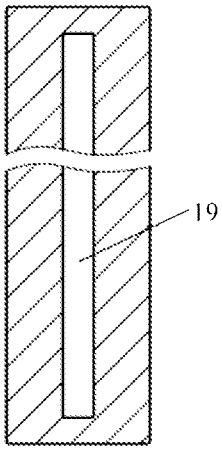
FIG. 9 is a sectional view of FIG. 8 along B-B.
Figure 10:
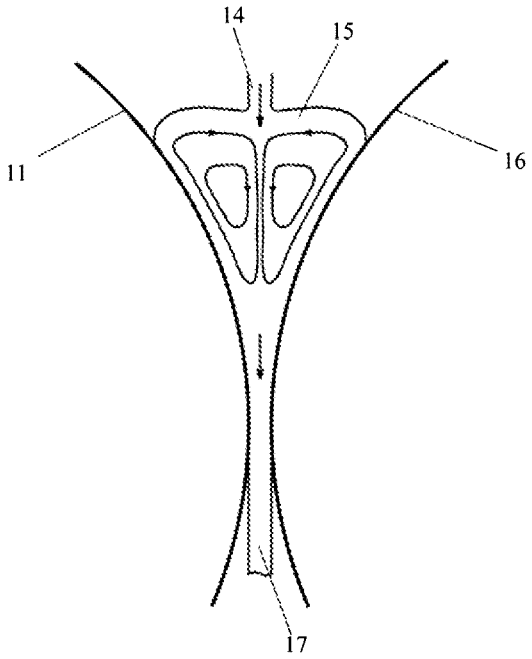
FIG. 10 is a schematic diagram of the momentum distribution and the whirlpool in the molten pool in Embodiment 2.

As shown in FIGS. 7-9, the vertical double-roller thin strip continuous casting device includes a first cooling roller 11 and a second cooling roller 16 which are arranged horizontally, and a roller gap is formed between the first cooling roller 11 and the second cooling roller 16. The flow distribution device 12 is arranged above the position where the first cooling roller 11 and the second cooling roller 16 are symmetrical, and the molten metal 13 flows out of the flow distribution device 12 to form a sheet-shaped molten metal flow 14 which is uniform in the axial direction and has an initial momentum. The flow distribution device 12 includes an inlet section 18 opened upward, which is configured to receive the molten metal from the tundish or flow groove; and, a vertical outlet section 19 connected to the inlet section 18, a continuous strip-shaped outlet being formed on the bottom of the vertical outlet section 19 to output the sheet-shaped molten metal flow 14. The length $l_3$ of the vertical outlet section 19 is 3-10 times, preferably 5-7 times of the thickness $t_2$ of the vertical outlet section 19. The sheet-shaped molten metal flow 14 enters the roller gap between the first cooling roller 11 and the second cooling roller 16 at an initial velocity of 0.5-2 m/s to form a molten pool 15, and the subsequent sheet-shaped molten metal flow 14 forms whirlpool momentum in the molten pool 15. The first cooling roller 11 and the second cooling roller 16 synchronously rotate in opposite directions, and the roller velocity may be 0.1-3 m/s. Under the action of the momentum stirring of the whirlpool, the solidification of the molten metal is completed. The prepared thin metal strip 17 is extracted from the roller gap between the first cooling roller 11 and the second cooling roller 16, and the solidification structure of the thin metal strip 17 is a uniform and fine equiaxed crystal structure.

In a comparative example, the molten metal enters the molten pool space along the intermediate position above the two cooling rollers at a superheat degree of 60° C. and an initial velocity of 0.8 m/s, and a whirlpool which is adjacent to the surfaces of the two cooling rollers and has a momentum stirring action is formed in the molten pool. Under the action of the momentum stirring of the whirlpool, the solidification of the molten metal is completed, and a thin metal strip is prepared. The solidification structure is a uniform and fine 100% equiaxed crystal structure, and the size of crystal grains is 100 m.

The thin metal strip continuous casting method provided by the present application is simple and convenient to operate, and can increase the proportion of equiaxed crystals of the thin metal strip solidification structure without changing the original material components and reducing the superheat heat. The proportion of equiaxed crystals can be as high as 100%. Thus, the crystal grains can be refined, and segregation can be alleviated. The present application can be applied to near-net-shape continuous casting of various thin metal strips such as steel and nonferrous metal.

Although the implementations of the present application are described above, the contents descried are only implementations used to understand the present application and not intended to limit the present application. Without departing from the spirit and scope disclosed by the present application, any person skilled in the art to which the application belongs can make any modifications and alterations to the forms and details of implementation. However, the protection scope of the present application shall still be subject to the scope defined by the appended claims.

The invention claimed is:

1. A thin metal strip continuous casting method using momentum flow distribution, comprising the following steps of:

(1) adjusting the position of a flow distribution device, and starting a double-roller thin strip continuous casting device;

(2) molten metal entering the flow distribution device, and the molten metal forming a sheet-shaped molten metal flow which is uniform in an axial direction and has an initial momentum after the molten metal passes through the flow distribution device;

(3) the sheet-shaped molten metal flow entering a molten pool at a superheat degree of 50-100° C. and an initial velocity of 0.5-2 m/s, where the flow distribution device is spaced apart from the molten pool, so that the flow distribution device does not come into contact with the molten pool;

(4) under the action of the initial velocity of the molten metal, in the molten pool, forming a whirlpool which is adjacent to surfaces of two cooling rollers and has a momentum stirring action; and (5) completing the solidification of the molten metal under the momentum stirring action of the whirlpool along with the rotation of the two cooling rollers to obtain a thin metal strip, where the solidification structure of the thin metal strip is a uniform and fine equiaxed crystal structure.

2. The thin metal strip continuous casting method according to claim 1, wherein the double-roller thin strip continuous casting device is an inclined double-roller thin strip continuous casting device comprising an upper cooling roller and a lower cooling roller; the upper cooling roller and the lower cooling roller are obliquely arranged, and a roller gap is formed between the upper cooling roller and the lower cooling roller; the flow distribution device is arranged above the lower cooling roller.

3. The thin metal strip continuous casting method according to claim 2, wherein the flow distribution device comprises:

an inlet section opened upward, which is configured to receive the molten metal;

a vertical outlet section connected to the inlet section, a continuous strip-shaped outlet being formed on the bottom of the vertical outlet section to output the sheet-shaped molten metal flow; and a flow guide plate, which is connected to one side of the vertical outlet section and configured to guide the sheet-shaped molten metal flow to flow out.

4. The thin metal strip continuous casting method according to claim 3, wherein a length of the vertical outlet section is 3-10 times of a thickness of the vertical outlet section, a length of the flow guide plate is 5-10 times of the thickness of the vertical outlet section, and a distance from an intersection of the flow guide plate and the vertical outlet section to a bottom of the vertical outlet section is 1.5-3 times of the thickness of the vertical outlet section.

5. The thin metal strip continuous casting method according to claim 4, wherein the length of the vertical outlet section is 5-7 times of the thickness of the vertical outlet section, the length of the flow guide plate is 7-8 times of the thickness of the vertical outlet section, and the distance from the intersection of the flow guide plate and the vertical outlet section to the bottom of the vertical outlet section is 2-2.5 times of the thickness of the vertical outlet section.

6. The thin metal strip continuous casting method according to claim 4, wherein an angle $\alpha$ between a connecting line of an output endpoint of the flow distribution device with an axis of the lower cooling roller and a vertical line is 0-70°, an angle $\beta$ between a connecting line of the axes of two cooling rollers and the vertical line is 30-90°, and the angle $\alpha$ is less than the angle $\beta$; a difference between an angle $\gamma$ between a plate surface of the flow guide plate and a horizontal line and the angle $\alpha$ is 0-5°.

7. The thin metal strip continuous casting method according to claim 6, wherein the angle $\alpha$ between the connecting line of the output endpoint of the flow distribution device with the axis of the lower cooling roller and the vertical line is 20-60°, the angle $\beta$ between the connecting line of the axes of two cooling rollers and the vertical line is 60-80°, and the angle $\alpha$ is less than the angle $\beta$; the difference between the angle $\gamma$ between the plate surface of the flow guide plate and the horizontal line and the angle $\alpha$ is 0-5°.

8. The thin metal strip continuous casting method according to claim 1, wherein the double-roller thin strip continuous casting device is a vertical double-roller thin strip continuous casting device comprising a first cooling roller and a second cooling roller which are arranged horizontally; the flow distribution device is arranged above the position where the first cooling roller and the second cooling roller are symmetrical, and a roller gap is formed therebetween.

9. The thin metal strip continuous casting method according to claim 8, wherein the flow distribution device comprises:

an inlet section opened upward, which is configured to receive the molten metal; and a vertical outlet section connected to the inlet section, a continuous strip-shaped outlet being formed on a bottom of a vertical outlet section to output the sheet-shaped molten metal flow.

10. The thin metal strip continuous casting method according to claim 9, wherein a length of the vertical outlet section is 3-10 times of a thickness of the vertical outlet section.

* * * * *